US008217850B1

(12) United States Patent
Jennings et al.

(10) Patent No.: US 8,217,850 B1
(45) Date of Patent: Jul. 10, 2012

(54) ADJUSTABLE BEAMWIDTH AVIATION ANTENNA WITH DIRECTIONAL AND OMNI-DIRECTIONAL RADIATION MODES

(75) Inventors: William C. Jennings, Iowa City, IA (US); James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 600 days.

(21) Appl. No.: 12/228,594

(22) Filed: Aug. 14, 2008

(51) Int. Cl.
*H01Q 21/10* (2006.01)

(52) U.S. Cl. ..... 343/810; 343/722; 343/853; 343/893; 343/812

(58) Field of Classification Search ..... None
See application file for complete search history.

(56) References Cited

U.S. PATENT DOCUMENTS 3,641,578 A * 2/1972 Spanos et al. ..... 343/773
3,711,127 A * 1/1973 Raffa ..... 285/124.5
3,811,127 A * 5/1974 Griffee et al. ..... 343/705
5,521,610 A * 5/1996 Rodal ..... 343/797
6,618,016 B1 * 9/2003 Hannan et al. ..... 343/705
7,271,775 B1 * 9/2007 Rossman et al. ..... 343/728
7,592,966 B2 * 9/2009 Tsai et al. ..... 343/828
2008/0136734 A1 * 6/2008 Manholm et al. ..... 343/893
2008/0258993 A1 * 10/2008 Gummalla et al. ..... 343/876

* cited by examiner

*Primary Examiner* — Trinh Dinh
(74) *Attorney, Agent, or Firm* — Donna P. Suchy; Daniel M. Barbieri

(57) ABSTRACT

The present invention is an adjustable beamwidth, loaded monopole antenna array. The array may include four monopole antennas. Each of the antennas may include a generally symmetric, tapered radiating element and an inductive shorting wall element. The array may further include a capacitive top hat element which may be connected to each of the antennas. The array may further include a ground plane element which may be connected to each of the antennas. The array may further include a plurality of feed posts which may be connected to the antennas. Further, each feed post may be connected to a power feed line. Each radiating element may be variably phase-fed and/or uniformly phase-fed for allowing the antenna array to effect a directional beam and/or an omni-directional beam.

20 Claims, 9 Drawing Sheets

ADJUSTABLE BEAMWIDTH AVIATION ANTENNA WITH DIRECTIONAL AND OMNI-DIRECTIONAL RADIATION MODES

FIELD OF THE INVENTION

The present invention relates to the field of Radio Frequency (RF) devices and Advanced Radio Systems and particularly to a system and method for providing an electrically small, 900 megahertz (MHz) to 10 gigahertz (GHz) ultra-wideband omni-directional and TCAS or CISS steerable directional antenna with GPS or XM circularly polarized antenna.

BACKGROUND OF THE INVENTION

A number of current RF devices (ex. —antennas), such as Traffic Alert and Collision Avoidance System (TCAS) or Configurable Integrated Surveillance System (CISS) antennas, may be large, intrinsically narrowband, may have less than desirable impedance matching characteristics and may have smaller-than-desired beamwidths.

Thus, it would be desirable to provide a system/method for providing an antenna which obviates the problems associated with current antennas.

SUMMARY OF THE INVENTION

Accordingly, an embodiment of the present invention is directed to an antenna array, including: a plurality of monopoles, each monopole included in the plurality of monopoles being configured with a capacitive hat element, a radiating element, and an inductive shorting element, wherein the radiating element of each monopole included in the plurality of monopoles is configured for being variably and/or uniformly phase-fed, thereby allowing the antenna array to effect at least one of: a directional beam and an omni-directional beam.

An additional embodiment of the present invention is directed to an adjustable beamwidth, loaded monopole antenna array, including: four monopole antennas, each monopole antenna included in the four monopole antennas being configured with a generally symmetric, tapered radiating element, and an inductive shorting wall element (ex. —an RF subsystems box shorting wall element)/inductive shorting post element/coax element shorting wall element; a capacitive top hat element configured for being connected to each of the four monopole antennas; a ground plane element configured for being connected to each of the four monopole antennas; and a plurality of feed posts, each feed post being configured for connecting to a monopole antenna included in the four monopole antennas, each feed post being further configured for connecting to a power feed line, wherein the radiating element of each monopole antenna included in the four monopole antennas is configured for being phase-fed (ex. —variably and/or uniformly phase-fed), thereby allowing the loaded monopole antenna array to effect at least one of: a directional beam and an omni-directional beam.

A further embodiment of the present invention is directed to a system, including: an adjustable beamwidth, loaded monopole antenna array, including: four monopole antennas, each monopole antenna included in the four monopole antennas being configured with a generally symmetric, tapered radiating element, and an inductive shorting wall element/inductive shorting post element; a capacitive top hat element configured for being connected to each of the four monopole antennas; a ground plane element configured for being connected to each of the four monopole antennas; and a plurality of feed posts, each feed post being configured for connecting to a monopole antenna included in the four monopole antennas, each feed post being further configured for connecting to a power feed line, wherein the radiating element of each monopole antenna included in the four monopole antennas is configured for being phase-fed, thereby allowing the loaded monopole antenna array to effect at least one of: a directional beam and an omni-directional beam; and a processor, the processor configured for being connected to and communicatively coupled with the monopole antenna array, the processor being at least one of a Traffic Alert and Collision Avoidance System (TCAS) processor and a Configurable Integrated Surveillance System (CISS) processor, wherein the monopole antenna array is at least one of a TCAS monopole antenna array and a CISS monopole antenna array.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
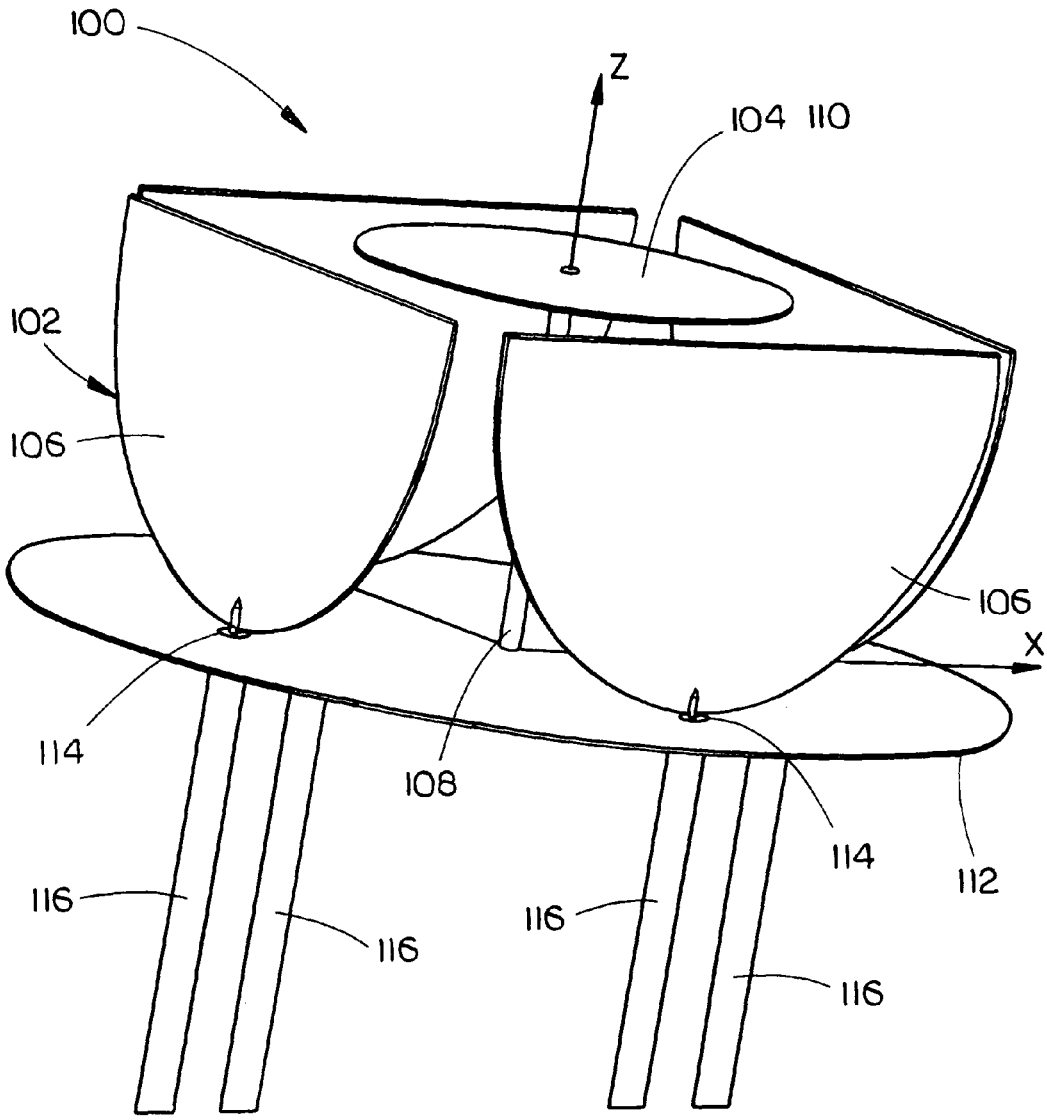
FIG. 1 is an isometric view of a loaded monopole antenna array in accordance with an exemplary embodiment of the present invention.

Reference will now be made in detail to the presently preferred embodiments of the invention, examples of which are illustrated in the accompanying drawings.

Current RF devices (ex. —antennas), such as Traffic Alert and Collision Avoidance System (TCAS) or Configurable Integrated Surveillance System (CISS) antennas, may be large, intrinsically narrowband, may have less than desirable impedance matching characteristics and may have smaller-than-desired beamwidths. Third generation TCAS III system antennas may provide a 10.5 inch diameter electronically steerable array. A goal of the present invention may be to provide for antenna coalescence of bands such as Global Positioning System (GPS) and Extended Module (XM) radio system into a single antenna module which has/promotes favorable size, weight, antenna count, air-drag reduction, ease of maintenance, and aircraft dispatch characteristics.

Ultra-wideband (UWB) reconfigurable antennas may be considered for applications to reduce antenna count on air transport, regional aircraft and next generation aircraft. Coalescing federated antennas may reduce aircraft drag and may provide accompanying savings in size, weight and power (SWaP). When many antennas are incorporated into the same structure, interference and coupling between transmitting and/or receiving elements may influence the operation and integrity of communication systems. Such inter-system isolation issues may be addressed via systems architecture.

TACAS/TCAS, Mode-S, DME, UAT and WiFi bands may be considered for coalescence since all may be vertically polarized and omni-directional with the exception of TACAS/TCAS which may be directional and omni-directional. Antennas may span frequencies from 960 MHz to 2500 MHz and may generally be located on a top and/or bottom of an airframe (ex. —both top and bottom in cases where federal regulations require redundant antennas for coverage and isolation. Coalescence of said antennas into a single, omni-directional/directional vertically polarized array may reduce the number of federated antennas on a large air transport by a factor of about 2 to 1. Said reduction may reduce initial cost and recurring costs of maintenance, as well as reducing size, weight, power, and cost (SWaP-C).

Traffic alert and collision avoidance systems (TCAS/TACAS) antennas may be intrinsically narrow band, may be poorly matched, and may have small/narrow beam width. The use of "fat" symmetric tapered planar monopoles for providing smooth impedance transition and broad bandwidth, as well as implementing parasitic loading of these radiators/antennas, may be the techniques which may be used for designing an antenna/antenna array which meets TACAS/TCAS directional requirements and UWB omni-directional requirements.

The present invention may implement a reactively loaded semi-elliptic monopole array antenna/antenna array for TACAS/TCAS and UWB applications. By parasitically loading an array of semi-elliptic planar monopoles, a UWB antenna may be implemented having good, dipole-like radiation characteristics. The antenna array may be constructed, for example, of sheet metal and may be implemented/configured as an array (ex. —rectangular array or circular array) of a plurality of planar elliptic monopole antennas (ex. —four planar elliptic monopole antennas) loaded with a shunt capacitive top hat. By adjusting the area of the top hat and a diameter of an inductive center support, the array may be intrinsically matched (ex. —to 50 Ohms) over a wide impedance bandwidth. The antenna/antenna array of the present invention may be well-suited for implementation in air communication, navigation, and surveillance applications by coalescing TACAS/TCAS, Mode-S, DME, UAT and WiFi bands into a single monolithic antenna structure with directional and omni-directional radiation modes.

Figure 2:
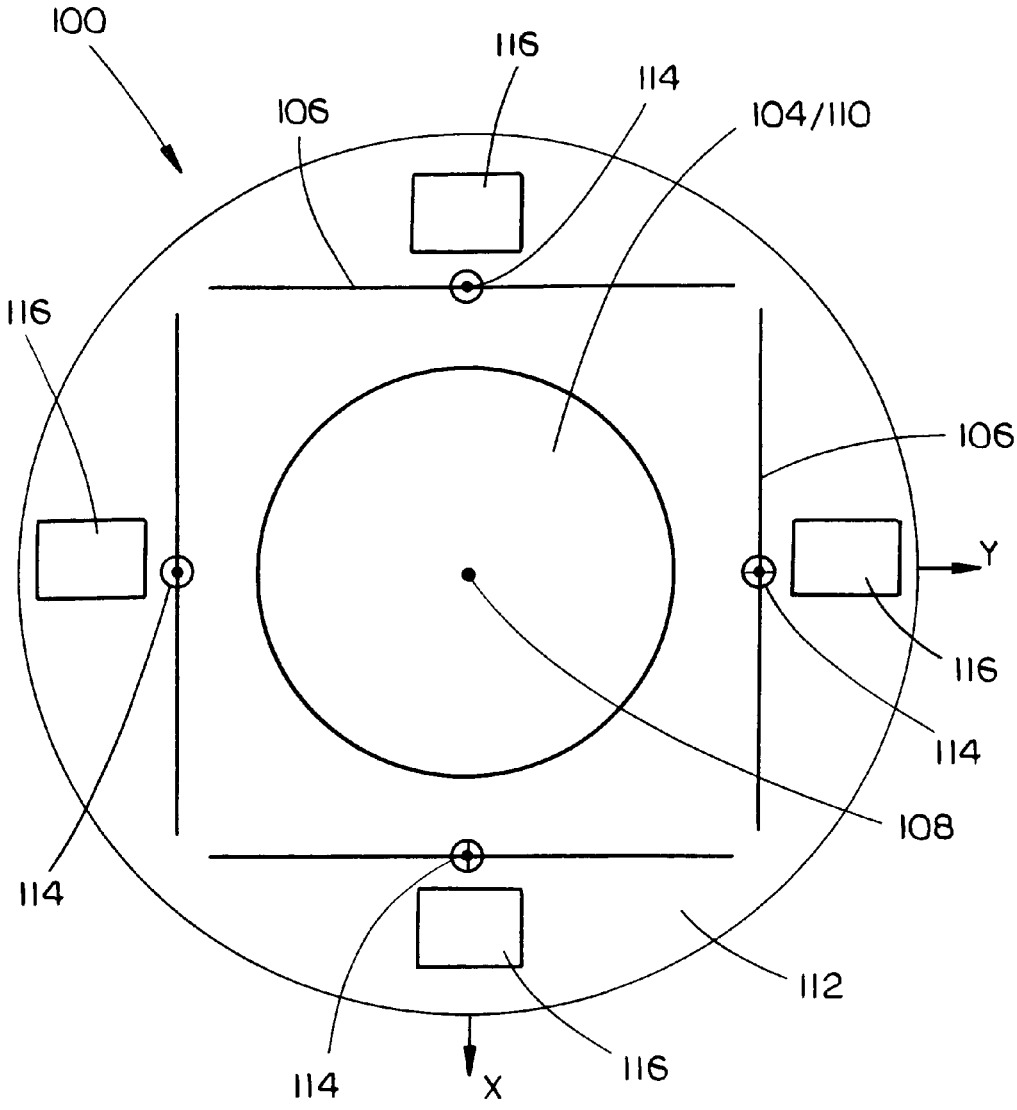
FIG. 2 is a top plan view of the loaded monopole antenna array of FIG. 1 in accordance with an exemplary embodiment of the present invention.
Figure 3:
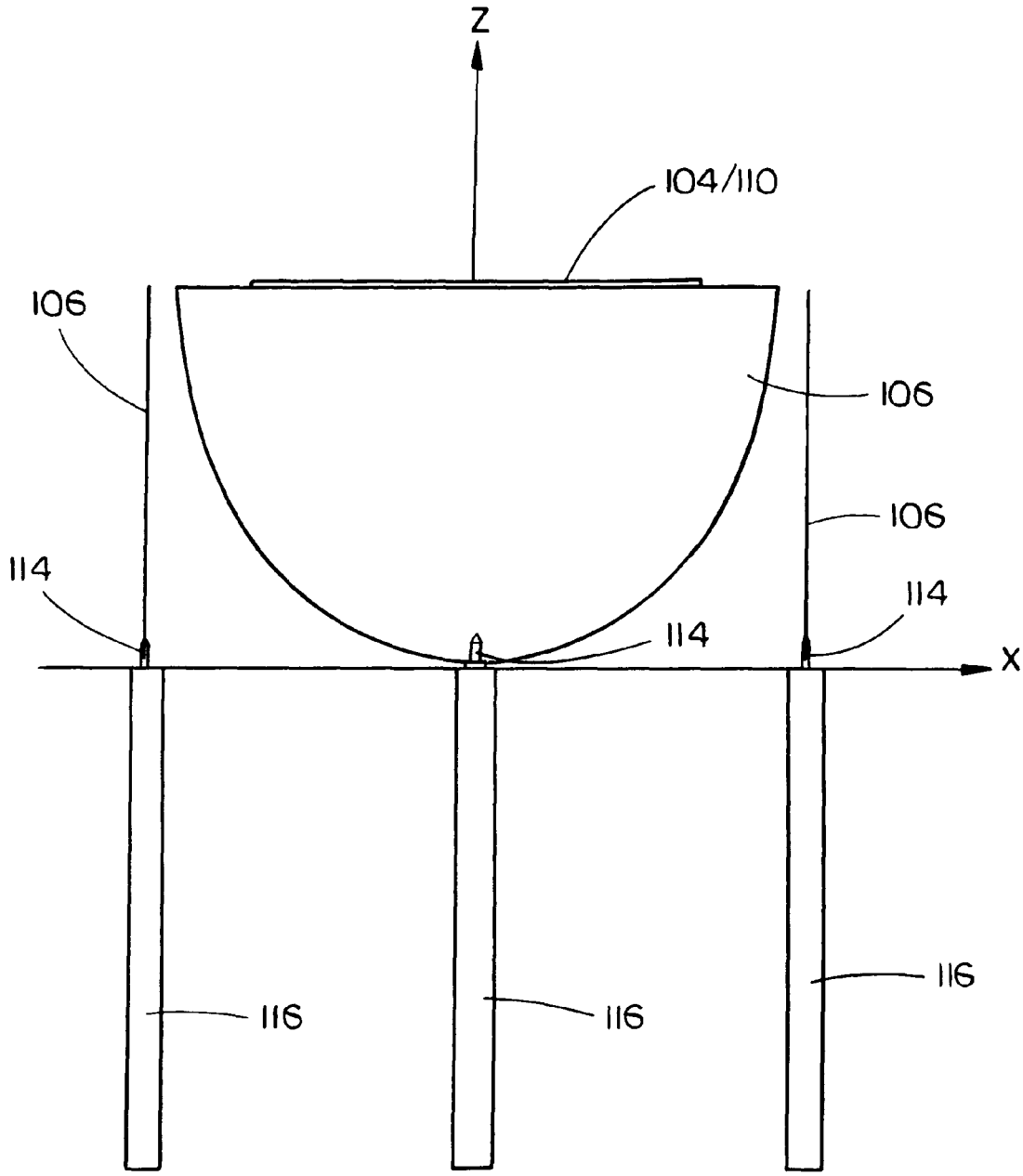
FIG. 3 is a side elevational view of the loaded monopole antenna array of FIG. 1 in accordance with an exemplary embodiment of the present invention.

Referring generally to FIGS. 1-3, an antenna array in accordance with an exemplary embodiment of the present invention is shown. In a current embodiment of the present invention, the antenna array 100 may include a plurality of monopoles/monopole antennas 102. For example, the antenna array 100 may include four monopole antennas 102 which may each be vertically polarized, omni-directional, broadband and electrically small. Further, each monopole antenna 102 may be configured with/may include a capacitive hat element 104. Additionally, each monopole antenna 102 may be configured with/may include a radiating element(s) 106. For instance, each radiating element 106 may be a generally symmetric, tapered or semi-elliptic radiating element 106 (ex. —a "fat" symmetric tapered radiator for providing smooth impedance transition/promoting improved impedance matching and promoting improved/broader bandwidth characteristics for the antenna array 100). Still further, each monopole antenna 102 may be configured with/may include an inductive shorting element 108. For example, each inductive shorting element 108 may be a shorting wall 108 or a shorting post/short post/inductive shorting post 108.

Figure 5:
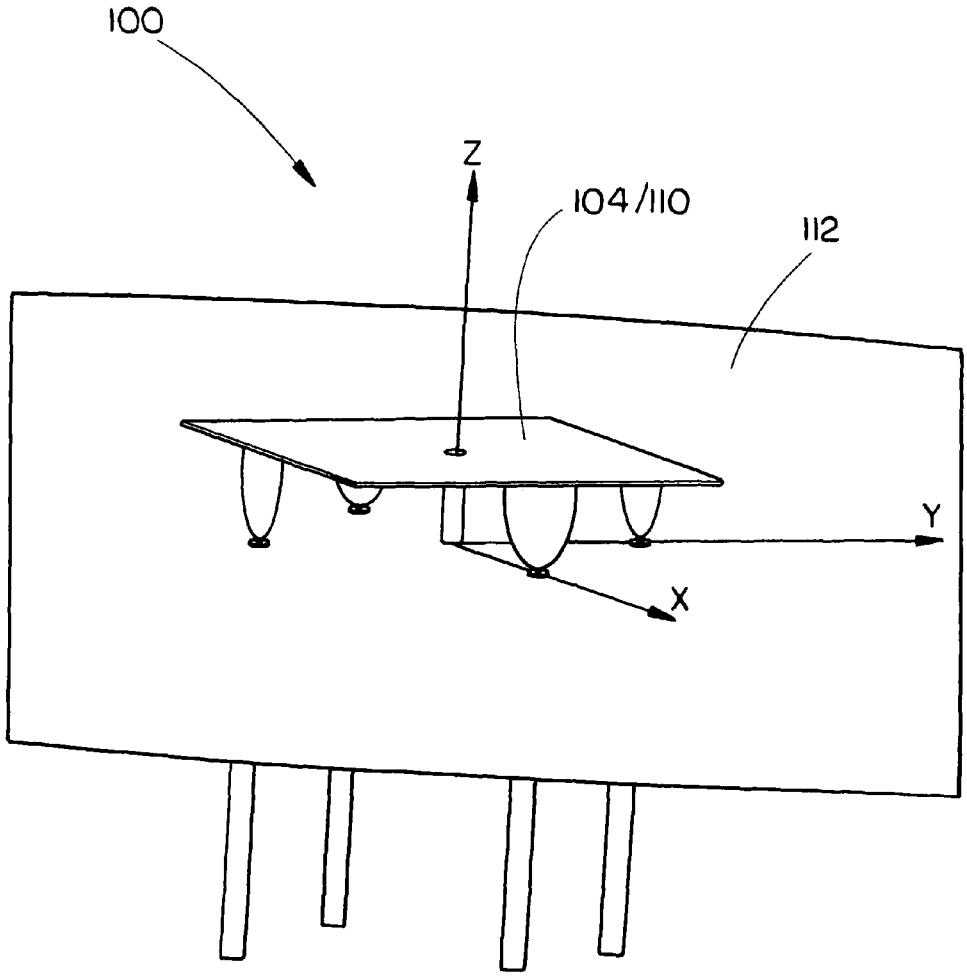
FIG. 5 is an isometric view of a monopole antenna/array which includes a square top hat/local ground plane and implements semi-elliptic planar monopoles which are configured parallel to edges of the top hat and directly below the top hat thereby forming a small separation or air gap between the monopoles and the top hat in accordance with an alternative exemplary embodiment of the present invention.
Figure 6:
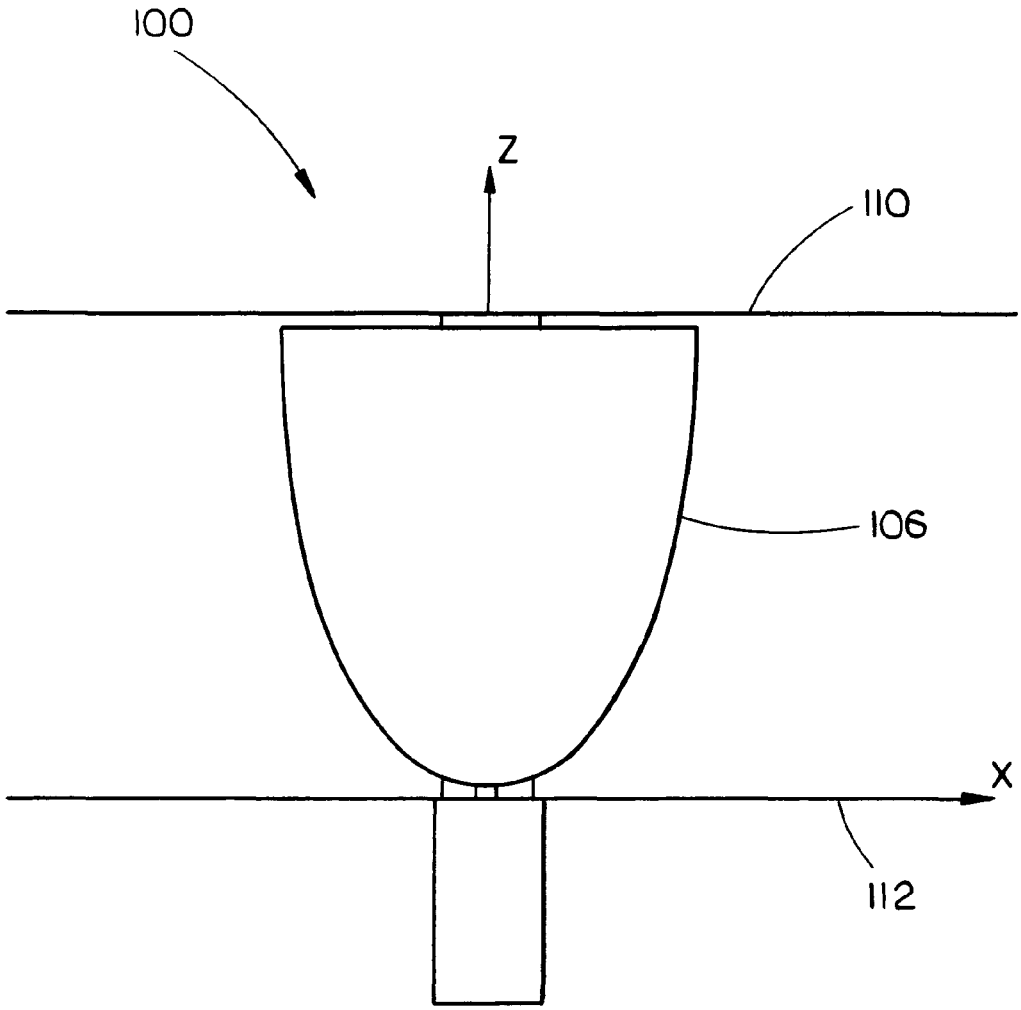
FIG. 6 is an isolated view of a semi-elliptic planar monopole included in the monopole antenna array shown in FIG. 5 in accordance with an exemplary embodiment of the present invention.
Figure 7:
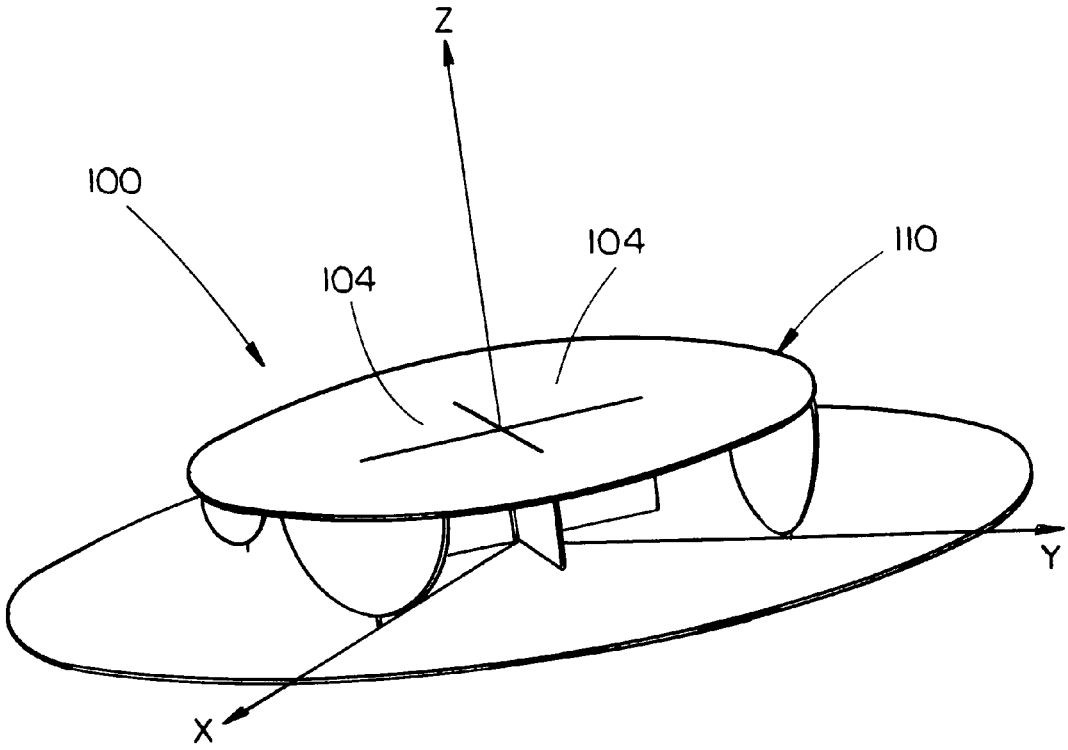
FIG. 7 is an isometric view of a monopole antenna array which implements a round top hat/local ground plane and semi-elliptic planar monopoles in accordance with an exemplary embodiment of the present invention.

In current embodiments of the present invention, the monopole antennas 102 may be configured/combined, for instance in various shapes, such as in a generally circular arrangement for providing a generally circular antenna array 100 (as shown in FIG. 7) or in a generally square arrangement (as shown in FIGS. 5 and 6) for providing a generally square antenna array 100. For example, in the generally circular arrangement, the capacitive hat elements 104 may be configured for collectively forming a generally disk-shaped capacitive top hat 110 for the array 100 (as shown in FIG. 7), while in the generally square arrangement, the capacitive hat elements 104 may be configured for collectively forming a generally square-shaped capacitive top hat for the array. The capacitive top hat 110 may be configured for being connected to or for being placed in proximity to each of the monopole antennas 102. For example, in the generally square arrangement of the array 100, as shown in FIGS. 5 and 6, the monopoles 106 may be configured such that said monopoles 106 are parallel to edges of the top hat 110 and situated directly below said top hat 110 with a small separation or air-gap between the monopoles 106 and the top hat 110. (see FIG. 6).

In further embodiments of the present invention, the antenna array 100 may include/may be configured for being connected to a ground plane element 112. For example, the ground plane element 112 may be configured for being connected to each of the monopole antennas 102 for allowing the antenna array 100 to be a Direct Current (DC) grounded antenna array for providing lightning protection for the antenna array 100.

In exemplary embodiments of the present invention, the antenna array 100 may include/may be configured for being connected to one or more feed posts 114. For instance, each feed post 114 may be configured for being connected to one or more of the monopole antennas 102. Further each feed post 114 may be configured for being connected to a power feed line 116. For example, the power feed line 116 may be a fifty (50) ohm coax feed line.

In current embodiments of the present invention, the antenna array 100 may be configured to radiate either omni-directionally or directionally. When radiating in an omni-directional mode, antenna array 100 may be fed with equal amplitude, equally-phased signals (ex. —may be uniformly phase-fed). When radiating in a directional mode, antenna array 100 may be fed with varied phase or varied amplitude signals (ex. —may be variably phase-fed). Phase may be varied using variable length transmission lines/delays and amplitude may be varied using variable attenuators/weights. Both the delays and weights may be controlled using/via a computer algorithm. Further, when configured to radiate directionally, the beamwidth of the radiation of the antenna array 100 may be altered by varying the phase delay or amplitude weights of the feeds to the elements of the array 100, thereby providing an antenna array 100/antenna structure suitable for an adaptive array using a computer algorithm. When configured to radiate directionally for TCAS or CISS, the beamwidth of the antenna array 100 may be adjusted appropriately for TCAS. Further, the beam may be azimuthally steered into any of four cardinal directions/sectors. In further embodiments, the antenna array may be a loaded monopole antenna array 100. For instance, each monopole antenna 102 may be loaded with a capacitive hat/capacitive hat element 104 (ex. —top hat load/disk hat/plate hat) and an inductive short/inductive short element/inductive shorting element 108 without using resistive loading of the radiating elements 106. The radiating element 106 of each monopole antenna 102 may be configured for being phase-fed or amplitude-fed, thereby allowing the loaded monopole antenna array 100 to effect a directional beam (ex. —directional mode) and/or an omni-directional beam (omni-directional mode). Further, the loaded monopole antenna array 100 may be configured for providing multiple discrete beams (ex. —the antenna array be configured to effect at least eight directional beams) at multiple/various beam widths. In further embodiments, a direction of a beam provided by the antenna array 100 may be alterable by varying a feed phase or amplitude of at least one of the radiating elements 106. Still further, the antenna array 100 may be an electrically small, low profile, ultra-wideband, steerable and/or adaptable-beam antenna array.

In embodiments in which the antenna array 100 is uniformly phase-fed (ex. —wherein the feed ports/feed posts 114/power feed lines 116 are uniformly phased), an omni-directional mode antenna pattern may be produced. When in a directional mode, a Butler matrix of four, 3 dB, 90-degree hybrid couplers may be implemented for providing a phase gradient across the monopole array feed ports/feed posts 114/power feed lines 116. As mentioned above, by appropriately phasing the ports/posts 114, the directional mode beam may be azimuthally steered to one of four cardinal or one of four inter-cardinal sectors. (ex. —the directional mode beam may be steered to eight principal sectors in azimuth). For TCAS applications, the beam may be steered into/in four cardinal directions.

In further embodiments of the present invention, the antenna array 100 may be a vertically polarized antenna array. In additional embodiments, the antenna array 100 may be integrated with/may be configured for connecting to/may implement a Butler matrix or similar beam forming network (BFN) for applying a phase gradient across antenna array elements/antenna array 100.

In exemplary embodiments of the present invention, the loaded monopole antenna array 100 may have an ultra-wide bandwidth, such as a bandwidth of 0.95 Gigahertz (GHz) to 10.0 Gigahertz (GHz). The antenna array 100 of the present invention may be configured for being electrically changed to an omni-directional/steerable antenna array. Further, the antenna array 100 may be configured for achieving a voltage standing wave ratio (VSWR) of at least two-to-one (2:1) over its bandwidth (ex. —an ultra-wide bandwidth/a 10:1 bandwidth, such as over a bandwidth of 0.95 GHz to 10.0 GHz), and may further be reconfigurable over the ultra-wide bandwidth of the antenna array 100. Still further, the antenna array 100 of the present invention may be configured for promoting higher gain, such that the antenna array 100 may achieve a beam directional gain of at least 2 decibels isotropic (dBi) at the horizon.

Figure 9:
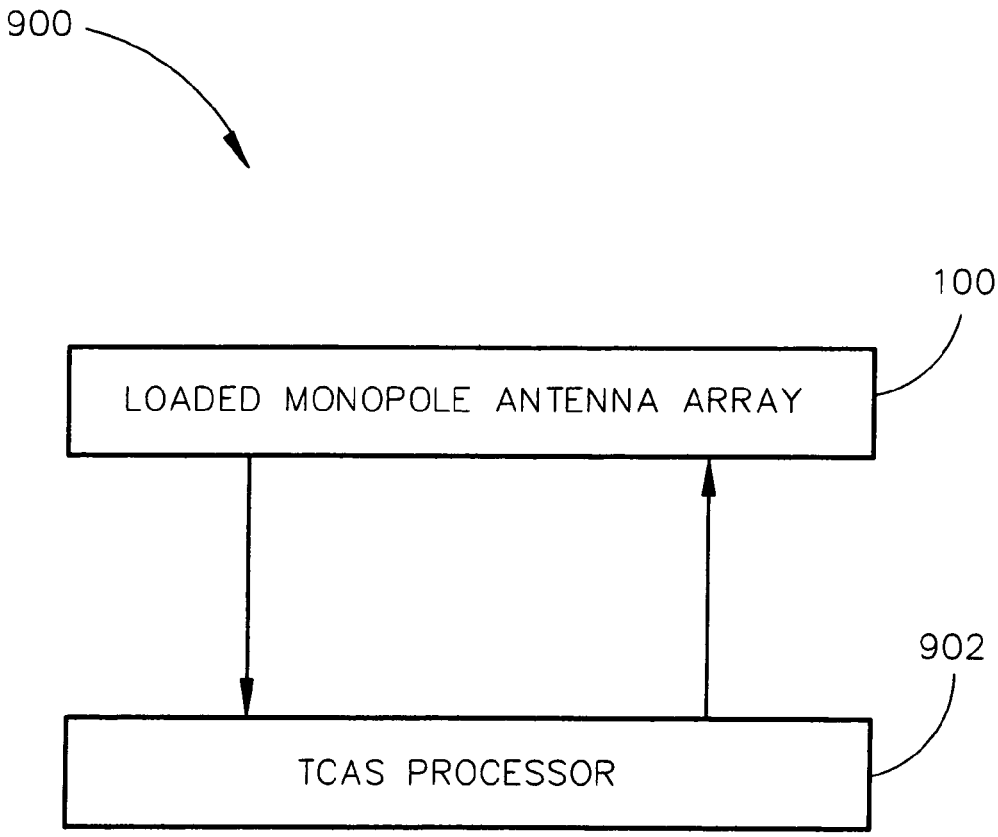
FIG. 9 is a view of a system implementing the monopole antenna array shown in FIG. 1 in accordance with an exemplary embodiment of the present invention.

In current embodiments of the present invention, the loaded monopole antenna array 100 may be implemented with/may be a subassembly of/may be implemented as part of a system 900. (as shown in FIG. 9). For example, the system 900 may be a surveillance system or a situational awareness system, such as a Traffic Alert and Collision Avoidance System (TCAS) or a Configurable Integrated Surveillance System (CISS). Further, the system 900 may include a processor 902, which may be configured for being connected to and communicatively coupled with the monopole antenna array 100. For instance, the processor 902 may be a TCAS processor or a CISS processor 902 and the antenna array 100 may be a TCAS antenna array/TCAS monopole antenna array or a CISS antenna array/CISS monopole antenna array. In further embodiments, the system 900 may include additional TCAS system components or CISS system components which may be implemented with the antenna array 100 of the present invention. In still further embodiments, due to its wide bandwidth, the antenna array 100 of the present invention may be implemented with/may coalesce with/may be implemented as part of a Distance Measuring Equipment (DME) system, a Universal Access Transceiver (UAT) system, a TCAS system (as discussed above), a Mode Select (Mode-S) system, and a Wireless Fidelity (WiFi) system.

In further embodiments, the antenna array 100 of the present invention may be constructed at least in part/formed at least in part of sheet metal, thereby providing a simple, lightweight design which may be manufactured at low cost. For embodiments in which the antenna array 100 is implemented with/includes a BFN or Butler matrix/Butler feed network/a combiner, a Printed Circuit Board (PCB) may be included in the design. The antenna array 100 of the present invention is easily scalable. In still further embodiments, additional radiating elements 108 or band radiators may be placed upon the capacitive top hat 110 for providing additional reconfigurability for the antenna array 100. In additional embodiments, the antenna array 100 may have a relatively small volume (ex. —a profile of 2 inches and a footprint of 12 square inches) compared to currently available antenna arrays.

A large variety of UWB/TCAS monopole array 100 embodiments may exist. In further embodiments of the antenna array 100, individual, semi-elliptic planar monopoles which make up the elements 106 of the array 100 may be oriented in various configurations, such as parallel to or perpendicular to top hat/top hat edge 110. Further, the top hat 110 may or may not be electrically connected to the individual semi-elliptic planar monopoles which make up the array elements 106. Additionally, the top hat 110 may or may not overlap the individual semi-elliptic planar monopoles which make up the array elements 106. Still further, the top hat 110 may be of generally arbitrary shape (ex. —disk, square, etc.). In exemplary embodiments, the top hat 110 may function as a parallel parasitic loading of the monopole array elements 106, wherein the loading required may have/implement various shapes/dimensions of top hat 110. Further, the loading required may have/may implement a variety of shapes/dimensions of shorting post/shorting wall 108.

In current embodiments of the present invention, the top hat 110 serves electrically as a capacitive element and the shorting posts/shorting walls 108 serve electrically as inductive elements of the parasitic load. Further, the top hat 110 may serve mechanically as a support for large, upward-looking satellite antennas and may serve electrically as the local ground plane 104/110. The shorting walls)/shorting post(s) 108 may serve mechanically to elevate the local ground or top hat 104/110 above the semi-elliptic monopole array 100 and to provide a conduit for power transmission to upward-looking, circularly-polarized antennas. The shorting wall(s)/shorting post(s) 108 may serve electrically to keep the local ground plane 104 and the monopole array ground plane/antenna system chassis 112 at equal electrical potential.

Figure 4:
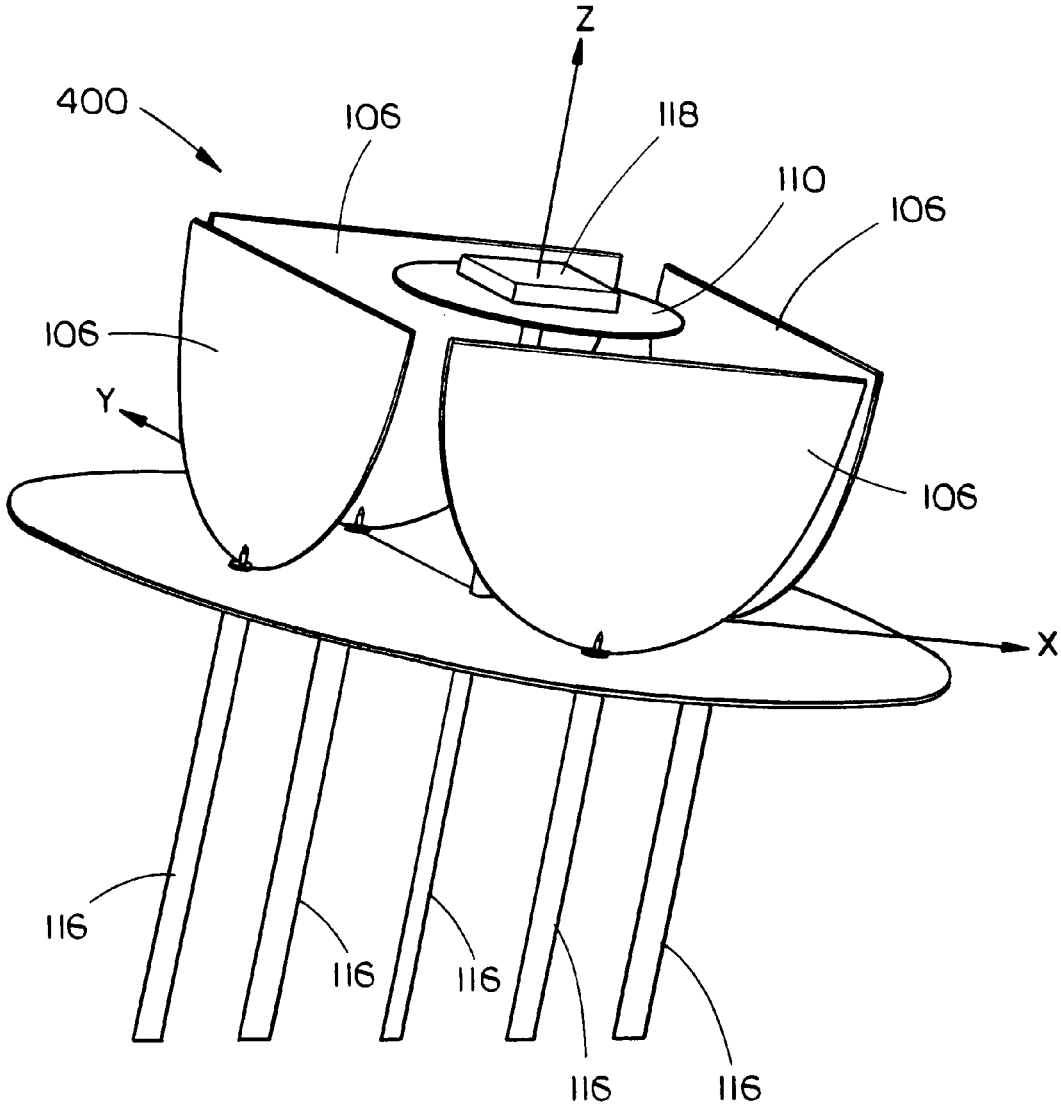
FIG. 4 is an isometric view of a monopole antenna array which includes circularly polarized L-band antenna(s) for upward-looking satellite communications in accordance with an alternative exemplary embodiment of the present invention.

In further embodiments, as shown in FIG. 4, an alternative antenna array 400 is shown. Said array 400 may be as/similar to the array 100 described above, but may also include a circularly-polarized (CP) microstrip GPS/XM/slot antenna/L-band antenna 118 which may be placed generally at the center of the top hat. The top hat 110 may provide a local ground plane for the various antenna structures (ex. —GPS, XM, etc.). Shorting post(s) may be replaced with coax cable (s) (ex. —rigid coax cable(s))/power feed line(s)/a line for connection to a CP GPS/XM port 116) for providing a conduit from the power feed to the CP microstrip/slot antenna(s) 118 mounted on the top hat. A conductive outer conductor of the rigid coaxial/coax cable may electrically connect a ground plane of the top hat 104/110 (ex. —local ground plane/top-hat local ground plane) with a ground plane 112 of the monopole array 100, the monopole antenna array ground plane 112 serving as a chassis for the monopole antenna array 100/overall antenna system. Said array 400 may be configured as a vertically-polarized, ultra-wide band, omni-directional and azimuthally steered TCAS directional semi-elliptic monopole array with augmented versatility (as shown in FIG. 4), so as to include circularly-polarized L-band antennas for upward-looking satellite communications.

Figure 8:
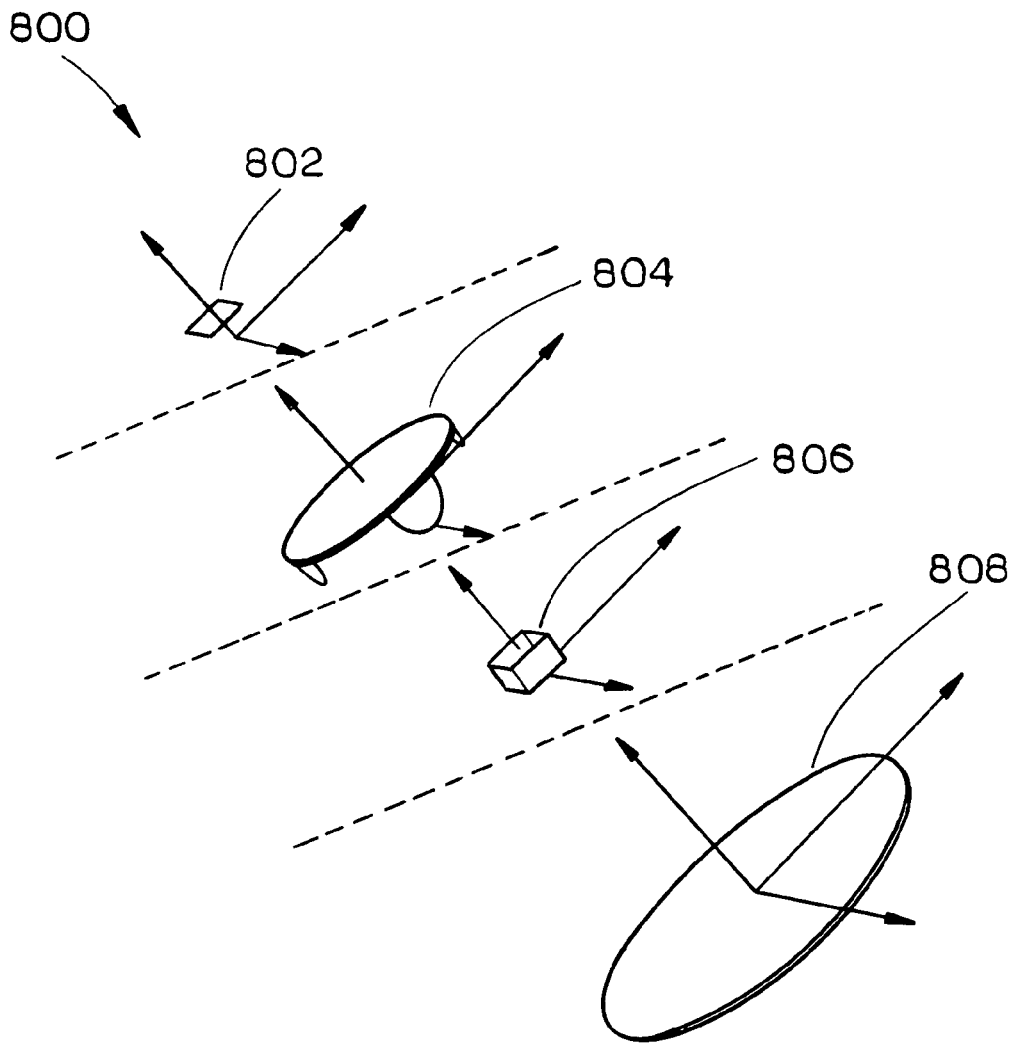
FIG. 8 is an exploded view of a monopole antenna array in accordance with a further alternative exemplary embodiment of the present invention.

In further alternative embodiments, the semi-elliptic planar monopoles which make up the array elements 106 of the antenna array 100 may be configured directly below the top hat 110 such that said monopole(s) 106 is/are connected to the top hat 110 via a small conductive connection or conductive bridge between the monopole 106 and the top hat 110. In additional alternative embodiments, an exploded view of an antenna array 800 shown in FIG. 8 may include a GPS antenna 802, a vertical polarity array antenna 804 (ex. —a directional or omni-directional vertical polarized semi-elliptic planar monopole array antenna). The GPS antenna 802 may be configured for connection to/mounting upon the vertical polarity array antenna 804. The antenna array 800 may further include an RF subsystems conductive box 806 and a ground plane 808, the RF subsystems conductive box 806 configured for connection between the vertical polarity array antenna 804 and the ground plane 808.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An antenna array, comprising:

a conductive ground plane;

a plurality of monopoles, each comprising a generally symmetric, tapered or semi-elliptic radiating element mounted on and substantially perpendicular to the conductive ground plane;

a capacitive hat positioned adjacent to the plurality of monopoles;

an inductive shorting element extending from the capacitive hat to the conductive ground plane;

a plurality of variable length feed lines, the plurality of variable length feed lines being connected to the plurality of radiating elements, wherein each variable length feed line is operatively connected to an associated radiating element and the plurality of variable length feed lines are configured to supply uniformly phase-fed signals to the radiating elements for causing the antenna to provide an omni-directional beam when the antenna array is in an omni-directional mode; and wherein the plurality of variable length feed lines is further configured to supply variably phase-fed signals to the radiating elements for causing the antenna to provide a directional beam when the antenna array is in a directional mode.

2. An antenna array as claimed in claim 1, wherein the antenna array is configured to effect at least eight directional beams.

3. An antenna array as claimed in claim 1, wherein the inductive shorting element comprises an antenna feed line, further comprising an additional antenna element mounted on the capacitive hat operative connected to receive signals via the antenna feed line.

4. An antenna array as claimed in claim 3, wherein:

the plurality of monopoles comprise a Traffic Collision Alert System (TCAS) antenna or a Configurable Integrated Surveillance System (CISS) antenna; and the additional antenna element comprises a Global Positioning System (GPS) antenna.

5. An antenna array as claimed in claim 1, wherein the plurality of monopoles are configured in one of: a generally circular arrangement and a generally square arrangement forming the antenna array.

6. An antenna array as claimed in claim 1, wherein the inductive shorting element is configured as at least one of: a shorting wall, a shorting post, and a coax cable.

7. An antenna array as claimed in claim 1, wherein the antenna array is configured for being connected to a feed post.

8. An adjustable beamwidth, loaded monopole antenna array, comprising:

four monopole antennas, each comprising a generally symmetric, tapered radiating element;

an inductive shorting element;

a capacitive hat;

a ground plane element configured for being connected to the four monopole antennas;

a plurality of feed posts, the plurality of feed posts configured being connected to the four monopole antennas; and a plurality of variable length power feed lines, the feed posts being configured for connecting to the plurality of variable length power feed lines, wherein each monopole antenna is mounted on and substantially perpendicular to the ground plane element and the of radiating elements are configured for being uniformly phase-fed when the antenna array is in an omni-directional mode for causing the antenna array to provide an omni-directional beam; and variably phase-fed via the variable length power feed lines when the antenna array is in a directional mode for causing the antenna array to provide a directional beam.

9. A loaded monopole antenna array as claimed in claim 8, wherein the four monopoles are configured in one of: a generally circular arrangement for providing a generally circular antenna array and a generally square arrangement for providing a generally square antenna array.

10. A loaded monopole antenna array as claimed in claim 8, wherein the antenna array is configured for connecting to at least one of: a Butler matrix and a beam forming network (BFN).

11. A loaded monopole antenna array as claimed in claim 8, wherein the loaded monopole antenna array is vertically polarized.

12. A loaded monopole antenna array as claimed in claim 8, wherein the loaded monopole antenna array is a Traffic Alert Collision Avoidance System (TCAS) antenna array.

13. A loaded monopole antenna array as claimed in claim 8, wherein the loaded monopole antenna array has a bandwidth of 0.95 Gigahertz (GHz) to 10.0 Gigahertz (GHz).

14. A loaded monopole antenna array as claimed in claim 13, wherein the loaded monopole antenna array is configured for achieving a voltage standing wave ratio (VSWR) of at least 2:1 (two-to-one) over the bandwidth.

15. A loaded monopole antenna array as claimed in claim 8, wherein the loaded monopole antenna array is configured for achieving a beam directional gain of at least 2.0 decibels.

16. A loaded monopole antenna array as claimed in claim 8, wherein the loaded monopole antenna array is configured for providing multiple discrete beams at multiple beam widths.

17. A loaded monopole antenna array as claimed in claim 8, wherein beam direction is alterable by altering a feed phase of at least one of the radiating elements.

18. A system, comprising:

an adjustable beamwidth, loaded monopole antenna array, including:

four monopole antennas, each comprising a generally symmetric, tapered radiating, element;

at least one inductive shorting element;

a capacitive hat;

a ground plane element configured for being connected to each of the four monopole antennas;

a plurality of feed posts, the plurality of feed posts configured for being connected to the four monopole antennas;

a plurality of variable length power feed lines, the plurality of variable length power feed lines being connected to the plurality of feed posts wherein the plurality of radiating elements of the four monopole antennas is configured for being uniformly phase-fed when the antenna array is in an omni-directional mode for causing the antenna array to provide an omni-directional beam; and variably phase-fed via the variable length power feed lines when the antenna array is in a directional mode for causing the antenna array to provide a directional beam;

wherein each monopole antenna is mounted on and substantially perpendicular to the ground plane; and a processor, the processor configured for being connected to and communicatively coupled with the monopole antenna array, the processor being at least one of a Traffic Alert and Collision Avoidance System (TCAS) processor and a Configurable Integrated Surveillance System (CISS) processor, wherein the monopole antenna array is at least one of a TCAS monopole antenna array and a CISS monopole antenna array.

19. The antenna array of claim 18, wherein the inductive shorting element comprises an antenna feed line, further comprising an additional antenna element mounted on the capacitive hat operative connected to receive signals via the antenna feed line.

20. The antenna array of claim 19, wherein:

the four monopole antennas comprise a Traffic Collision Alert System (TCAS) antenna or a Configurable Integrated Surveillance System (CISS) antenna; and the additional antenna element comprises a Global Positioning System (GPS) antenna.

* * * * *